US007637080B2

(12) United States Patent
Trebbi

(10) Patent No.: US 7,637,080 B2
(45) Date of Patent: Dec. 29, 2009

(54) INTERMITTENT MOTION CAPSULE FILLING MACHINE

(75) Inventor: Roberto Trebbi, Castenaso (IT)

(73) Assignee: I.M.A. Industria Macchine Automatiche S.p.A., Ozzano Emilia (IT)

( * ) Notice: Subject to any disclaimer, the term of this patent is extended or adjusted under 35 U.S.C. 154(b) by 0 days.

(21) Appl. No.: 11/996,481

(22) PCT Filed: Jul. 24, 2006

(86) PCT No.: PCT/IB2006/002133

§ 371 (c)(1),
(2), (4) Date: Jan. 22, 2008

(87) PCT Pub. No.: WO2007/012966

PCT Pub. Date: Feb. 1, 2007

(65) Prior Publication Data

US 2008/0209858 A1 Sep. 4, 2008

(30) Foreign Application Priority Data

Jul. 28, 2005 (EP) ..... 05425556

(51) Int. Cl.
*B65B 1/10* (2006.01)

(52) U.S. Cl. ..... 53/267; 53/237; 53/287; 53/471

(58) Field of Classification Search ..... 53/471, 53/476, 900, 129.1, 131.1, 237, 267, 286, 53/287; 141/69, 71, 73, 156, 237
See application file for complete search history.

(56) References Cited

U.S. PATENT DOCUMENTS 1,993,716 A * 3/1935 Hanley et al. ..... 53/281
2,322,169 A * 6/1943 Smith ..... 53/437
3,078,629 A * 2/1963 Besemer et al. ..... 53/471
3,446,404 A * 5/1969 Mehta ..... 222/225
3,552,095 A * 1/1971 Inman ..... 53/390
4,450,877 A 5/1984 Walker et al.
4,640,448 A * 2/1987 Trechsel ..... 222/636
4,782,644 A * 11/1988 Haarer et al. ..... 53/282
4,884,602 A * 12/1989 Yamamoto et al. ..... 141/242

(Continued)

FOREIGN PATENT DOCUMENTS

FR 2 348 972 A1 11/1977

*Primary Examiner*—Paul R Durand
(74) *Attorney, Agent, or Firm*—Pearne & Gordon LLP

(57) ABSTRACT

A capsule filling machine (10) for producing hard gelatin capsules (C) of the type with lid and body (3, 4) containing particles (12) of pharmaceutical material, in particular microtablets (12) or pellets comprises a rotary carousel (2) mounting a plurality of slide units (5) for holding and handling the capsules (C) in order to open and then close the capsules (C) by first separating and then pairing the capsule lids (3) and bodies (4); and means (11) for feeding the particles (12) to the carousel (2) for filling doses of the particles (12) into the respective capsule bodies (4); the feed means (11) comprise at least one hopper (13) containing a mass of these particles (12), and roller means (14) partly immersed in said mass of particles (12) in the hopper (13); the roller means (14) having a plurality of suction recesses (15) for accommodating and retaining a predetermined number of the particles (12) drawn from the hopper (13) and then releasing the particles (12) into a series of hollow conduits (16) mounted on the carousel (2).

8 Claims, 2 Drawing Sheets

U.S. PATENT DOCUMENTS 4,964,262 A * 10/1990 Moser et al. ..... 53/506
5,474,092 A * 12/1995 Moser et al. ..... 131/280
5,743,069 A * 4/1998 Ansaloni ..... 53/282
6,170,226 B1 * 1/2001 Chang ..... 53/64
6,367,228 B1 * 4/2002 Wurst et al. ..... 53/381.4
6,834,475 B2 * 12/2004 Trebbi et al. ..... 53/253
2004/0168400 A1 9/2004 Johnston et al.

* cited by examiner

INTERMITTENT MOTION CAPSULE FILLING MACHINE

TECHNICAL FIELD

This invention relates to a capsule filling machine for producing hard gelatin capsules containing pharmaceutical material.

In particular, the pharmaceutical material filled into hard gelatin capsules of the type with lid and body which this invention advantageously relates to is in the form of particles such as microtablets, micropellets, pellets or the like.

BACKGROUND ART

At present, a capsule filling machine normally comprises a central turret or carousel that rotates intermittently and that is equipped with a plurality of operating units positioned around the periphery of the turret and driven by the turret itself through intermittent drive means.

Each operating unit around the turret comprises a mounting slide holding one or more capsules to be transported to a plurality of working stations which perform, according to a known method, the various steps in the process cycle, that is to say, feeding and orienting the closed capsules, opening each capsule by separating the capsule body from the capsule lid, filling a quantity of pharmaceutical material into the capsule body, closing the capsule body with its lid and, lastly, expelling the full closed capsule thus made.

Following a predetermined cycle, dosing units of known type, each comprising a hollow cylindrical punch with a piston inside it (usually pneumatically driven), withdraw the pharmaceutical material by lowering the cylindrical punch into the pharmaceutical material contained in a tank associated with the turret and then lifting the piston in such a way as to draw a predetermined dose of the material into the cylindrical punch previously lowered into the tank.

Next, the cylindrical punch is lifted out of the tank and after removing excess material from it by scraping or brushing, the piston is lowered in such a way as to push the volumetric dose of material out of the cylindrical punch chamber and into the capsule body that has in the meantime lined up with it.

At present, dosing units of this type are used to good advantage to precisely dose pharmaceutical material in powder form, whereas, if the capsules have to be filled with particulate material such as microtablets or micropellets, dosing is not equally precise.

Indeed, whereas the piston in the cylindrical punch can withdraw constantly precise, volumetrically dosed quantities of pharmaceutical material in powder form, in the case of microtablets, pellets or the like, the force applied by the piston is not equally effective in withdrawing predetermined, constant numbers of microtablets to be filled into the respective capsule bodies.

DISCLOSURE OF THE INVENTION

The present invention therefore has for an aim to provide a capsule filling machine that overcomes the above mentioned drawback.

Specifically, the aim of this invention is to provide an improved capsule filling machine that can offer high dosing precision.

Another aim of the invention is to propose a capsule filling machine which, besides the above mentioned dosing precision, can continue to guarantee the levels of dependability, productivity and safety required of these machines, as well as the same high operating speed typical of current capsule filling machines, especially high-output, continuous motion capsule filling machines.

This invention accordingly provides a capsule filling machine for producing hard gelatin capsules of the type with lid and body containing particles of pharmaceutical material, in particular microtablets or pellets, the machine comprising a rotary carousel mounting a plurality of slide units for holding and handling the capsules in order to open and then close the capsules by first separating and then pairing the capsule lids and bodies; and means for feeding the particles to the carousel for filling doses of the particles into the respective capsule bodies; the machine being characterised in that the feed means comprise at least one hopper containing a mass of these particles, and roller means partly immersed in said mass of particles in the hopper; the roller means having a plurality of suction recesses for accommodating and retaining a predetermined number of the particles drawn from the hopper and then releasing the particles into a series of hollow conduits mounted on the carousel.

BRIEF DESCRIPTION OF THE DRAWINGS

The characteristics and advantages of the invention will become more apparent from the following detailed description of a preferred, non-restricting embodiment of it, illustrated purely by way of a example in the accompanying drawings in which.

DETAILED DESCRIPTION OF THE PREFERRED EMBODIMENTS OF THE INVENTION

Figure 1:
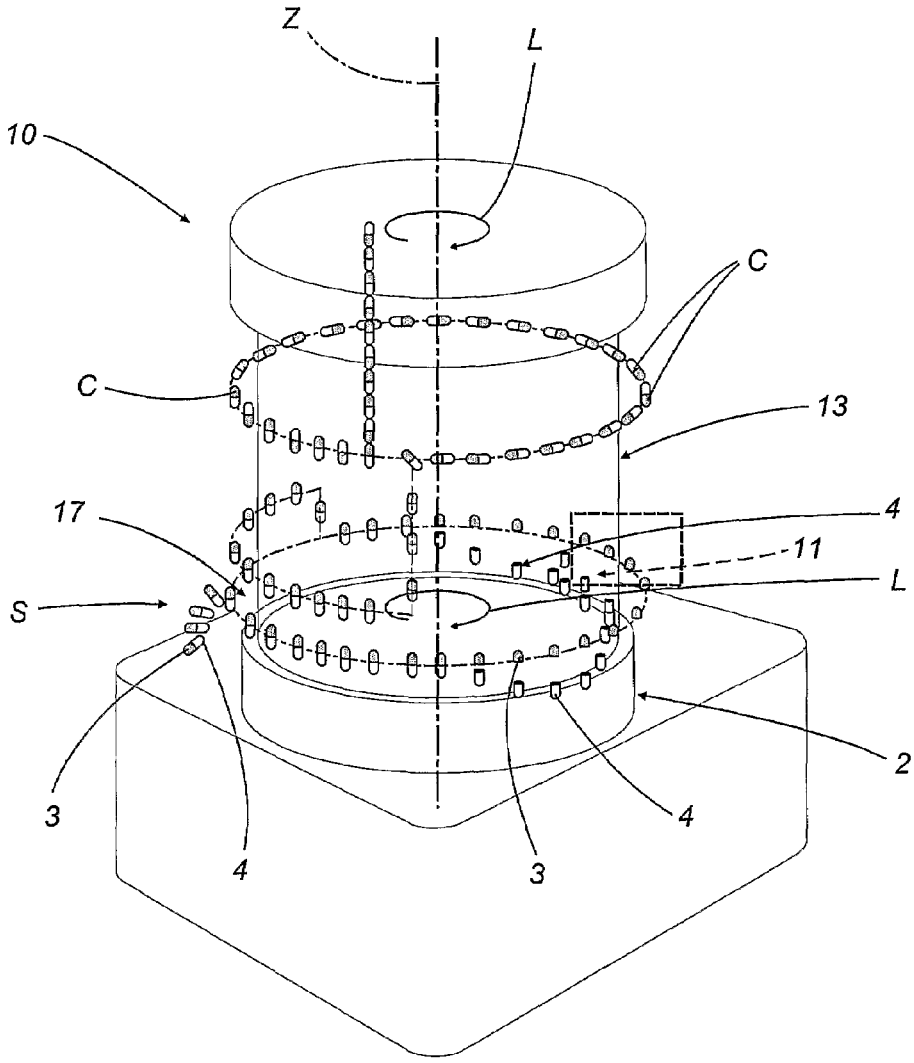
FIG. 1 schematically illustrates the operating cycle of an intermittent motion capsule filling machine according to the present invention.

With reference to FIG. 1, the capsule filling machine according to the invention, denoted in its entirety by the numeral 10, is used for filling customary capsules C of the type with a lid and a body, labelled 3 and 4 respectively, with predetermined quantities of particles 12 of pharmaceutical material, in particular pharmaceutical microtablets, pellets or the like.

The capsule filling machine 10 comprises a carousel 2 that rotates intermittently about a vertical axis Z in the direction indicated by the arrow L and that is radially equipped with arms 2*a*, 2*b* (FIG. 2) mounting a plurality of slide units 5 for holding and moving the capsule C bodies 4 in a horizontal direction.

Figure 2:
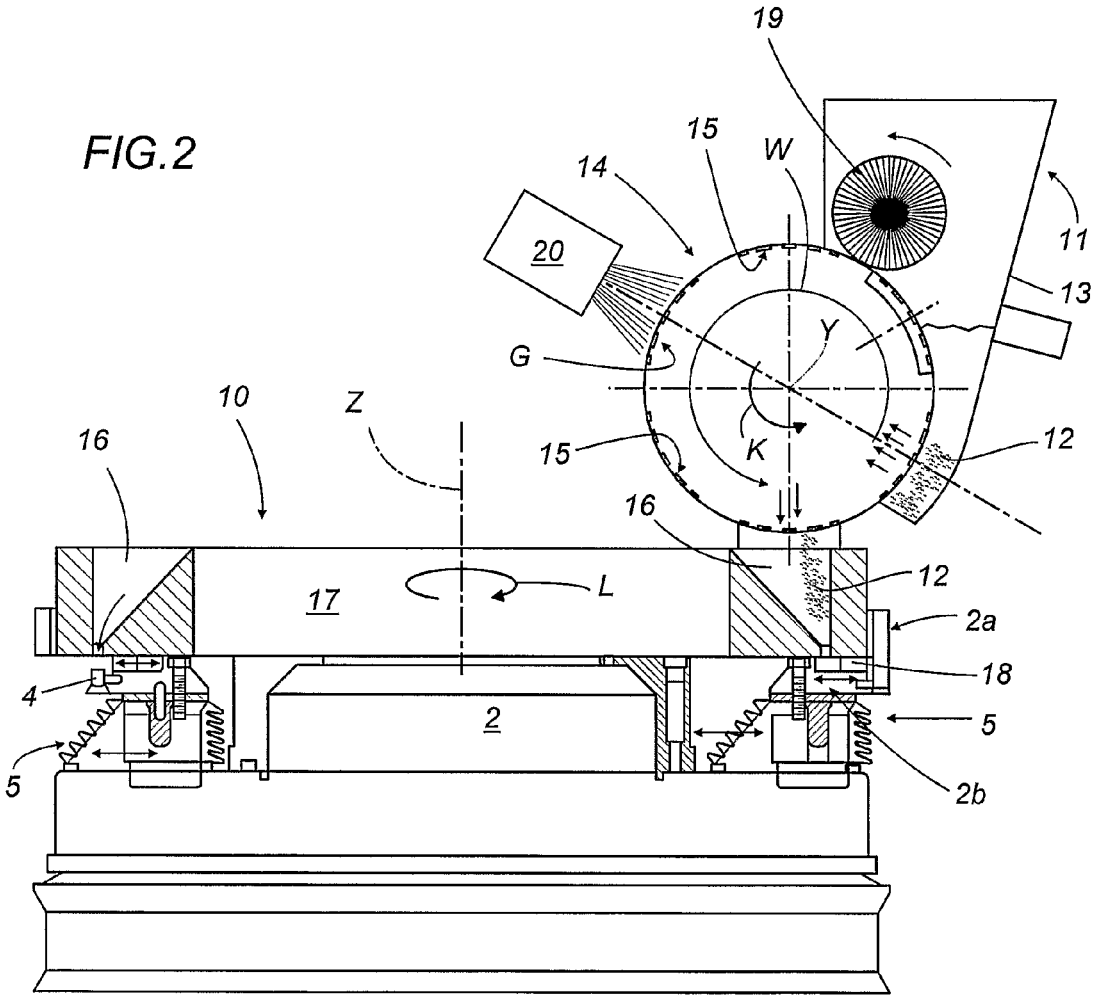
FIG. 2 is a schematic front view, partly in cross section and with some parts cut away for clarity, of a part of the capsule filling machine of FIG. 1.

As better illustrated in FIG. 2, the machine 10 also comprises at least one unit 11 for feeding microtablets 12 of pharmaceutical material collected in a mass inside a hopper 13.

The unit 11, illustrated simply as a block in dashed line style in FIG. 1, also comprises, in addition to the hopper 13, a pick-up roller 14 that rotates (in an anticlockwise direction K in FIG. 2) about a horizontal axis Y transversal to the axis Z; the roller 14 is partially immersed in the mass of microtablets 12 in the hopper 13, and has hollow recesses 15 on its cylindrical lateral surface, uniformly distributed in groups to form arrays G, for accommodating the microtablets 12.

The hollow recesses 15 are connected along an arc W to a vacuum source (of customary type and not illustrated) to accommodate and retain a predetermined number of microtablets 12 picked up by suction from the hopper 13 to be subsequently released into a series of funnel-like hollow conduits 16 made side by side and equally distributed on a disc-like element 17 attached to the carousel 2 and therefore rotating intermittently as one with it in the direction L about the axis Z.

Each funnel-like conduit 16 is designed to receive one or more microtablets 12 dropping out of one or more recesses 15 in the roller 14, the bottom end of the conduit 16 being temporarily closed by reciprocating plate means 18 mounted on the arm 2*b*, and then opened during the intermittent rotation of the carousel 2 in such a way as to allow the microtablets 12 to drop out of the open conduit 16 into a respective capsule body 4 under it (see left-hand portion of the carousel 2 in FIG. 2).

Coupled with the roller 14, there are rotary scraper means 19 that rotate in the same direction as the roller 14 and that are designed to enable the hollow recesses 15 to be uniformly filled and to scrape the excess microtablets 12 off the roller 14 so they falls back into the mass. The unit 11 also comprises display and detection sensor means 20 designed to check that the arrays G of recesses 15 are filled with the exact, predetermined number of microtablets 12 to be filled into the capsule bodies 4 on the slide unit 5 through the funnel-like conduits 16 on the disc-like element 17.

Preferably, the sensor means 20 comprise a camera 20 that can be connected (in known manner that is not illustrated) to means for activating units for rejecting capsules C that are not correctly filled with the microtablets 12.

In use, according to the cycle illustrated in FIGS. 1 and 2, the carousel 2 picks up the capsules C from a hopper at the top (of known type and not illustrated) containing empty capsules C. The capsules C are then accommodated one by one in the slide units 5 which hold the capsules C while each capsule C goes through successive steps during which the capsule C is opened by separating the lid 3 from the body 4, the body 4 is filled with a predetermined quantity of microtablets 12 by the above mentioned feed unit 11, and the body 4 is closed by its lid 3 and, lastly, the finished capsule C is expelled from the capsule filling machine 10 at an outfeed area S (FIG. 1).

The capsule filling machine as described above therefore achieves the above mentioned aims thanks to a simple feed nozzle structure with which it is possible to dose the exact number of microtablets to be filled into the capsules.

Obviously, the dose of microtablets 12 to be filled into each capsule C can be varied by simply varying the number of recesses 15 on the roller 14.

The size of the recesses 15 and of the funnel-like conduits 16 may also obviously vary, as may the profile of the cavities formed by the recesses 15 arranged in arrays on the lateral surface of the pickup roller 14 of the feed unit 11.

It will be understood that this invention can be modified and adapted in several ways for practical application purposes, without thereby departing from the scope of the solution as claimed hereunder.

The invention claimed is:

1. A capsule filling machine (10) for producing hard gelatin capsules (C) of the type with lid and body (3, 4) containing particles (12) of pharmaceutical material, the machine (10) comprising a rotary carousel (2) mounting a plurality of slide units (5) for holding and handling the capsules (C) in order to open and then close the capsules (C) by first separating and then pairing the capsule lids (3) and bodies (4); and means (11) for feeding the particles (12) to the carousel (2) for filling doses of the particles (12) into the respective capsule bodies (4); the machine (10) being characterised in that the feed means (11) comprise at least one hopper (13) containing a mass of these particles (12), and roller means (14) partly immersed in said mass of particles (12) in the hopper (13); the roller means (14) having a plurality of suction recesses (15) for accommodating and retaining a predetermined number of the particles (12) drawn from the hopper (13) and then releasing the particles (12) into a series of hollow conduits (16) mounted on the carousel (2), the machine (10) further comprising detection means (20) effective to sense and determine whether the recesses (15) of the roller means (14) are properly filled with the predetermined number of particles (12), the machine (10) being effective, through operation of the detection means, to reject capsules that are not correctly filled.

2. The capsule filling machine according to claim 1, characterised in that the hollow conduits (16) are uniformly distributed on a disc-like (17) element mounted on the carousel (2) in such a way as to rotate as one with the carousel (2) itself.

3. The capsule filling machine according to claim 2, characterised in that the conduits (16) are substantially funnel-shaped so as to collect the particles (12) falling from the roller means (14) and to place the particles (12) into the bodies (4) of the capsules (C); reciprocating plate means (18) being provided for closing the bottom ends of the conduits (16) in order to collect the particles falling out of the recesses (15) of the roller means (14).

4. The capsule filling machine according to claim 1, characterised in that the conduits (16) are substantially funnel-shaped so as to collect the particles (12) falling from the roller means (14) and to place the particles (12) into the bodies (4) of the capsules (C); reciprocating plate means (18) being provided for closing the bottom ends of the conduits (16) in order to collect the particles falling out of the recesses (15) of the roller means (14).

5. The capsule filling machine according to claim 1, characterised in that the machine also comprises rotary scraper means (19) coupled with the roller means (14), the rotary scraper means (19) being effective, through rotation, to enable the hollow recesses (15) to be correctly filled and to cause the excess particles (12) to fall back into the mass in the hopper (13).

6. The machine according to claim 5, wherein the rotary scraper means (19) rotates in the same direction as the roller means (14) to scrape excess particles (12) off the roller means (14) so the excess particles (12) fall back into the mass in the hopper (13).

7. The machine according to claim 1, where the detection means (20) comprises a camera.

8. The machine according to claim 1, wherein the particles (12) are microtablets or pellets.

* * * * *